US007070316B1

(12) United States Patent
Roth

(10) Patent No.: US 7,070,316 B1
(45) Date of Patent: Jul. 4, 2006

(54) MORTAR MIXING APPARATUS

(76) Inventor: James A. Roth, 12904 S. Mason, Palos Heights, IL (US) 60463

( * ) Notice: Subject to any disclaimer, the term of this patent is extended or adjusted under 35 U.S.C. 154(b) by 102 days.

(21) Appl. No.: 10/610,661

(22) Filed: Jul. 1, 2003

(51) Int. Cl.
*B28C 5/08* (2006.01)

(52) U.S. Cl. ..... 366/64; 366/48; 366/242; 366/347

(58) Field of Classification Search ..... 366/45, 366/46, 47, 48, 64, 242, 244, 247, 347
See application file for complete search history.

(56) References Cited

U.S. PATENT DOCUMENTS

| | | | | | |
|---|---|---|---|---|---|
| 2,039,277 | A | * | 5/1936 | Baehr | 366/347 |
| 2,517,648 | A | * | 8/1950 | Franke | 366/347 |
| 2,681,211 | A | * | 6/1954 | Reynolds | 366/251 |
| 2,744,735 | A | * | 5/1956 | Selvage | 366/46 |
| 3,042,434 | A | * | 7/1962 | Heiniger | 403/373 |
| 3,211,436 | A | * | 10/1965 | Butterfield | 366/67 |
| 3,321,188 | A | * | 5/1967 | Unger | 366/244 |
| 4,060,225 | A | * | 11/1977 | Cunningham | 366/46 |
| 4,063,716 | A | * | 12/1977 | Aitken, Jr. | 366/48 |
| 4,074,764 | A | * | 2/1978 | Enters | 172/42 |
| 4,155,656 | A | * | 5/1979 | Kramer | 366/347 |
| D332,722 | S | * | 1/1993 | Torbet et al. | D7/412 |
| 5,556,203 | A | * | 9/1996 | Filias | 366/347 |
| 5,772,318 | A | * | 6/1998 | Vadnais | 366/64 |
| 5,791,777 | A | * | 8/1998 | Mak | 366/129 |
| D404,252 | S | * | 1/1999 | Myers et al. | 366/347 |
| 5,893,640 | A | * | 4/1999 | Myers et al. | 366/347 |
| 6,000,836 | A | * | 12/1999 | Nemazi et al. | 366/64 |
| 6,176,610 | B1 | * | 1/2001 | Myers et al. | 366/347 |
| 6,749,328 | B1 | * | 6/2004 | Killen | 366/48 |
| 2001/0040838 | A1 | * | 11/2001 | Buchsteiner et al. | 366/244 |

* cited by examiner

*Primary Examiner*—Tony G. Soohoo

(57) ABSTRACT

A mortar mixing apparatus for simplifying mortar mixing that can be used with a conventional wheelbarrow comprises a rigid planar safety shield having a top side and a bottom side. A mixer motor is connected to the safety shield top side. A mixing blade is rotatably connected to the safety shield bottom side. The mixing blade is drivingly connected to the mixer motor.

19 Claims, 4 Drawing Sheets

MORTAR MIXING APPARATUS

BACKGROUND OF THE INVENTION

1. Field of the Invention

The present invention relates to a mortar mixing apparatus for use in connection with concrete mixers. The mortar mixing apparatus has particular utility in connection with concrete mixers which is connectable with a conventional wheelbarrow.

2. Description of the Prior Art

Mortar mixing apparatus are desirable for use on jobs requiring small amounts of concrete for work such as fence laying, mailbox post mounting and for brick laying. Currently for mixing small amounts of concrete buckets or wheelbarrows are used, the concrete mix is poured into the container with water and a shovel is used to mix the batch. The problems stemming from this are incomplete mixing, waste and additional physical labor to mix the batch. A need was felt for a mixer that could be mounted to a conventional wheelbarrow to mix concrete, and which would have a safety shield and be capable of movement about the wheelbarrow to fully mix the concrete.

The use of concrete mixers is known in the prior art. For example, U.S. Pat. No. 4,060,225 to Cunningham discloses a wheelbarrow with removable mixer having upright side and end walls includes a generally U-shaped, upwardly opening cutout in one of the end walls. A mixing unit can be mounted to the wheelbarrow by placing a mounting plate of the unit over the cutout. The mixing unit comprises an elongate shaft protruding through the mounting plate into the container and means for driving the shaft. A mixing blade defined by axially spaced first and second arms which are angularly offset with respect to each other and attached to the shaft adjacent the mounting plate and adjacent a free shaft end, respectively, is also provided. The first arm of the blade extends radially away from the shaft and the second arm extends radially and axially away from the free shaft end while a generally longitudinally extending, twisted blade section interconnects free ends of the first and second arms. However, the Cunningham '225 patent does not have a safety panel enclosing the mixer within the wheelbarrow and does not have two push pull handles for complete physical control of the mixer.

Similarly, U.S. Pat. No. 3,211,436 to Butterfield discloses a mortar mixing attachment for an earth moving machine bucket with end wall apertures. The attachment comprises a rotary shaft structure adapted to be rotatingly received in the apertures. A bearing assembly is rotatably supporting one end of the shaft structure. A means secures the bearing assembly to one of the bucket end walls. A rotary hydraulic motor driving unit drives the other end of the shaft structure. A means secures the driving unit to the other bucket end wall. Multiple mixing agitators are secured to the shaft at longitudinally spaced intervals therealong. The agitators include spring arms of arcuate configuration and of substantially semi-circular extent that have their inner ends secured to the shaft structure. The arms partially encircle the shaft structure. The agitators also include mixing paddles secured to the outer ends of the arms. However, the Butterfield '436 patent does not have a safety panel enclosing the mixer within the wheelbarrow and does not have two push pull handles for complete physical control of the mixer.

Lastly, U.S. Pat. No. 2,744,735 to Selvage discloses a combined wheelbarrow and mixer comprising an axle and ground engaging wheels disposed on the axle to provide a roll about structure. A tray is mounted on the frame. The tray defining a mixing chamber having a pouring spout leading therefrom through which contents of the chamber may be discharged. Stirring paddles are disposed within the chamber for mixing the contents thereof. A drive mechanism actuates the paddles and includes a motor carried by the frame. The motor is disposed ahead of the axle and the mixing chamber is located in back of the axle. The motor and chamber partially balance one another. The spout extends laterally beyond the motor in all directions and overlies the motor. However, the Selvage '735 patent does not have a safety panel enclosing the mixer within the wheelbarrow and does not have two push pull handles for complete physical control of the mixer.

While the above-described devices fulfill their respective, particular objectives and requirements, the aforementioned patents do not describe a mortar mixing apparatus that allows concrete mixers which is connectable with a conventional wheelbarrow. The Cunningham '225, Butterfield '436 and Selvage '735 patents make no provision for a safety panel enclosing the mixer within the wheelbarrow and do not have two push pull handles for complete physical control of the mixer.

Therefore, a need exists for a new and improved mortar mixing apparatus which can be used for concrete mixers which is connectable with a conventional wheelbarrow. In this regard, the present invention substantially fulfills this need. In this respect, the mortar mixing apparatus according to the present invention substantially departs from the conventional concepts and designs of the prior art, and in doing so provides an apparatus primarily developed for the purpose of concrete mixers which is connectable with a conventional wheelbarrow.

SUMMARY OF THE INVENTION

In view of the foregoing disadvantages inherent in the known types of concrete mixers now present in the prior art, the present invention provides an improved mortar mixing apparatus, and overcomes the above-mentioned disadvantages and drawbacks of the prior art. As such, the general purpose of the present invention, which will be described subsequently in greater detail, is to provide a new and improved mortar mixing apparatus and method which has all the advantages of the prior art mentioned heretofore and many novel features that result in a mortar mixing apparatus which is not anticipated, rendered obvious, suggested, or even implied by the prior art, either alone or in any combination thereof.

To attain this, the present invention essentially comprises a rigid planar safety shield having a top side and a bottom side. A mixer motor is connected to the safety shield top side. A mixing blade is rotatably connected to the safety shield bottom side. The mixing blade is drivingly connected to the mixer motor.

There has thus been outlined, rather broadly, the more important features of the invention in order that the detailed description thereof that follows may be better understood and in order that the present contribution to the art may be better appreciated.

The invention may also include a first push-pull handle, a second push-pull handle, a forward handle, an axle, a bearing, a driven sprocket, a drive sprocket and a drive chain. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mortar mixing apparatus that has all of the advantages of the prior art concrete mixers and none of the disadvantages.

It is another object of the present invention to provide a new and improved mortar mixing apparatus that may be easily and efficiently manufactured and marketed.

An even further object of the present invention is to provide a new and improved mortar mixing apparatus that has a low cost of manufacture with regard to both materials and labor, and which accordingly is then susceptible of low prices of sale to the consuming public, thereby making such mortar mixing apparatus economically available to the buying public.

Still another object of the present invention is to provide a new mortar mixing apparatus that provides in the apparatuses and methods of the prior art some of the advantages thereof, while simultaneously overcoming some of the disadvantages normally associated therewith.

Lastly, it is an object of the present invention is to provide a mortar mixing apparatus for concrete mixers which is connectable with a conventional wheelbarrow.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
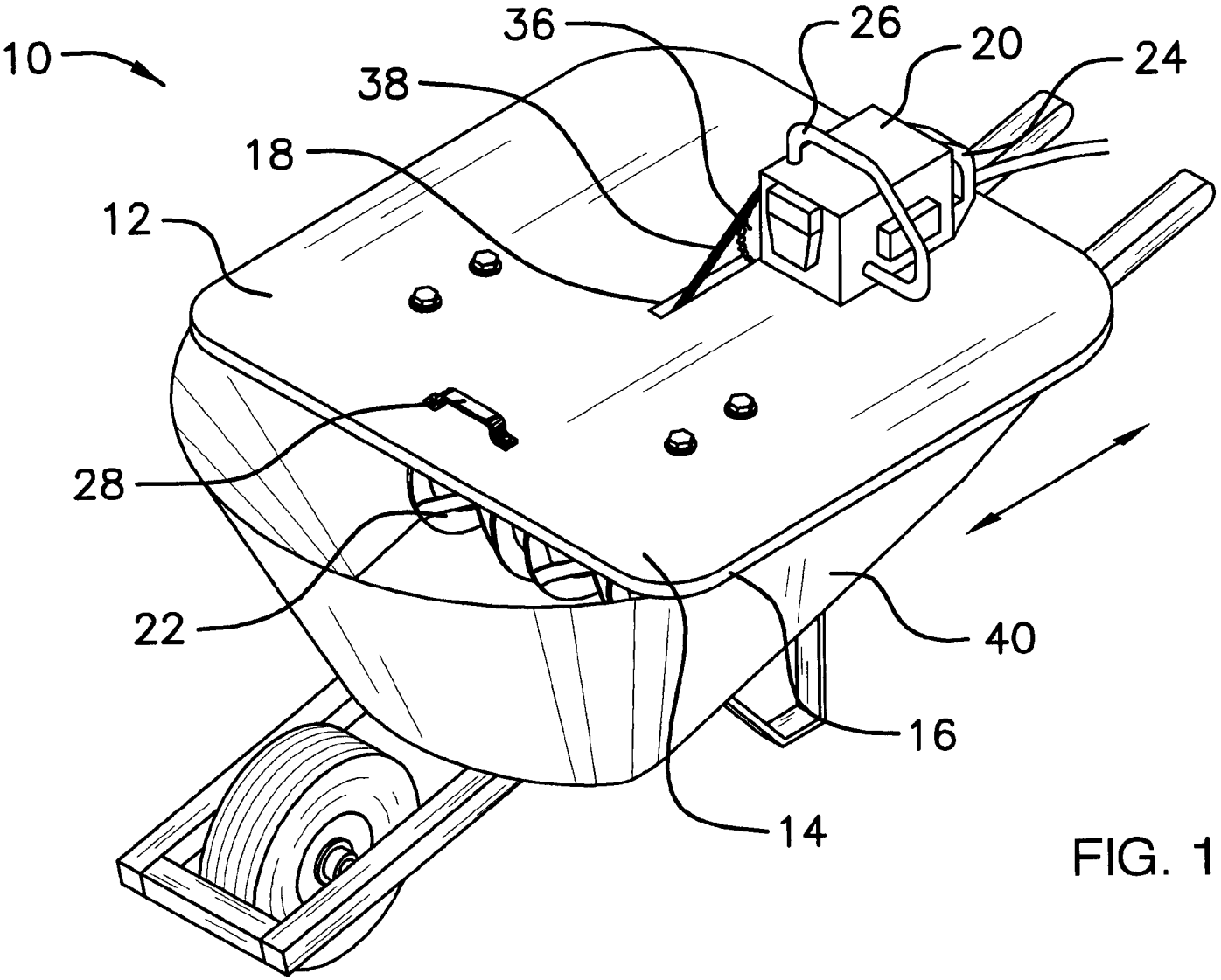
FIG. 1 is a top perspective view of the preferred embodiment of the mortar mixing apparatus constructed in accordance with the principles of the present invention.

Referring now to the drawings, and particularly to FIGS. 1–5, a preferred embodiment of the mortar mixing apparatus of the present invention is shown and generally designated by the reference numeral 10.

In FIG. 1, a new and improved mortar mixing apparatus 10 of the present invention for concrete mixers which is connectable with a conventional wheelbarrow 40 is illustrated and will be described. More particularly, the mortar mixing apparatus 10 has a rigid planar safety shield 12 having a top side 14 and a bottom side 16. The safety shield 12 has a drive slot therethru 18. The safety shield 12 is made of plywood in the present example, and is several inches wider and longer than the conventional wheelbarrow 40. In the present example the safety shield is ¾ inch thick plywood, 31 inches wide by 31 inches long. A mixer motor 20 is connected to the safety shield top side 14. The mixer motor of the present example is a converted chainsaw motor and thus has the incorporated safety features of a chainsaw. A mixing blade 22 is rotatably connected to the safety shield bottom side 16. In the present example there are two mixing blades 22. The mixing blade 22 is drivingly connected to the mixer motor 20. A first push-pull handle 24 is connected to the mixer motor 20. A second push-pull handle 26 is connected to the mixer motor 20. A forward handle 28 is connected to the safety shield 12. A drive sprocket 36 is connected to the mixer motor 20. A drive chain 38 is drivingly connected to the mixer motor 20. The drive chain 38 is connected to the drive sprocket 36.

Figure 2:
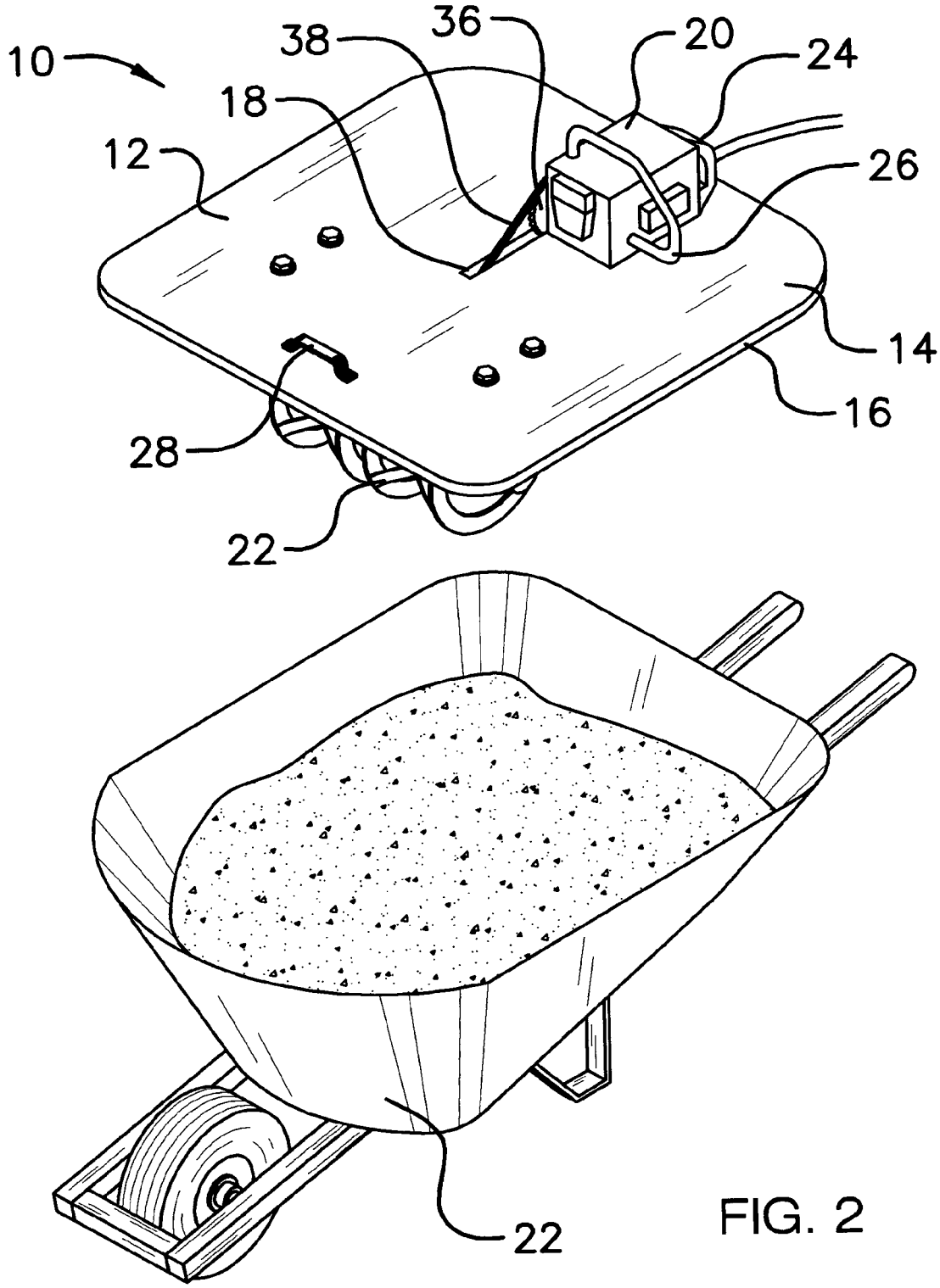
FIG. 2 is a top perspective view of the mortar mixing apparatus of the present invention.

In FIG. 2, the mortar mixing apparatus 10 is illustrated and will be described. More particularly, the mortar mixing apparatus 10 has the rigid planar safety shield 12 having the top side 14 and the bottom side 16. The safety shield 12 has the drive slot therethru 18. The mixer motor 20 is connected to the safety shield top side 14. The mixing blade 22 is rotatably connected to the safety shield bottom side 16. The mixing blade 22 is drivingly connected to the mixer motor 20. The first push-pull handle 24 is connected to the mixer motor 20. The second push-pull handle 26 is connected to the mixer motor 20. The forward handle 28 is connected to the safety shield 12. The drive sprocket 36 is connected to the mixer motor 20. The drive chain 38 is drivingly connected to the mixer motor 20. The drive chain 38 is connected to the drive sprocket 36.

Figure 3:
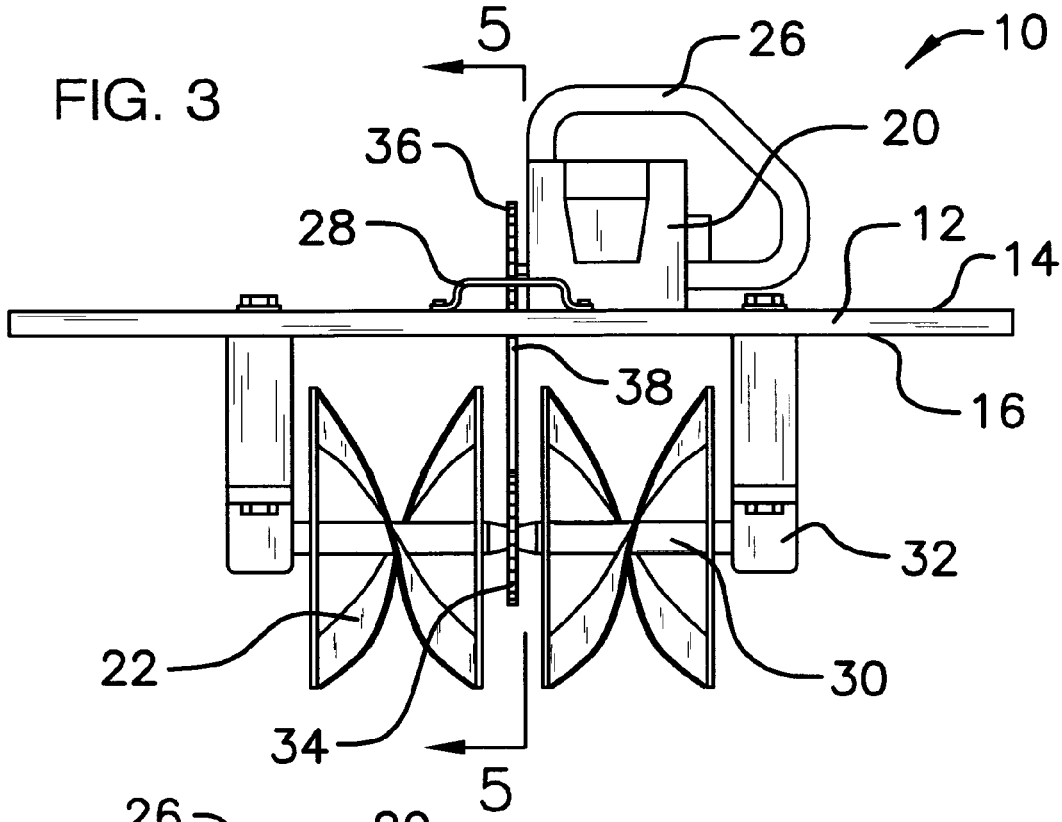
FIG. 3 is a front side view of the mortar mixing apparatus of the present invention.

In FIG. 3, the mortar mixing apparatus 10 is illustrated and will be described. More particularly, the mortar mixing apparatus 10 has the rigid planar safety shield 12 having the top side 14 and the bottom side 16. The mixer motor 20 is connected to the safety shield top side 14. The mixing blade 22 is rotatably connected to the safety shield bottom side 16. The mixing blade 22 is drivingly connected to the mixer motor 20. The second push-pull handle 26 is connected to the mixer motor 20. The forward handle 28 is connected to the safety shield 12. An axle 30 is connected to the mixing blade 22. A bearing 32 is rotatably connected to the axle 30 and is the pillow block bearing in the present embodiment.

In the present embodiment a mounting block is connected to the safety shield bottom side 16. The mounting block is connected to the bearing 32. A driven sprocket 34 is connected to axle 30. The drive sprocket 36 is connected to the mixer motor 20. The drive chain 38 is drivingly connected to the mixer motor 20. The drive chain 38 is connected to the drive sprocket 36. The drive chain 38 is connected to the driven sprocket 34.

Figure 4:
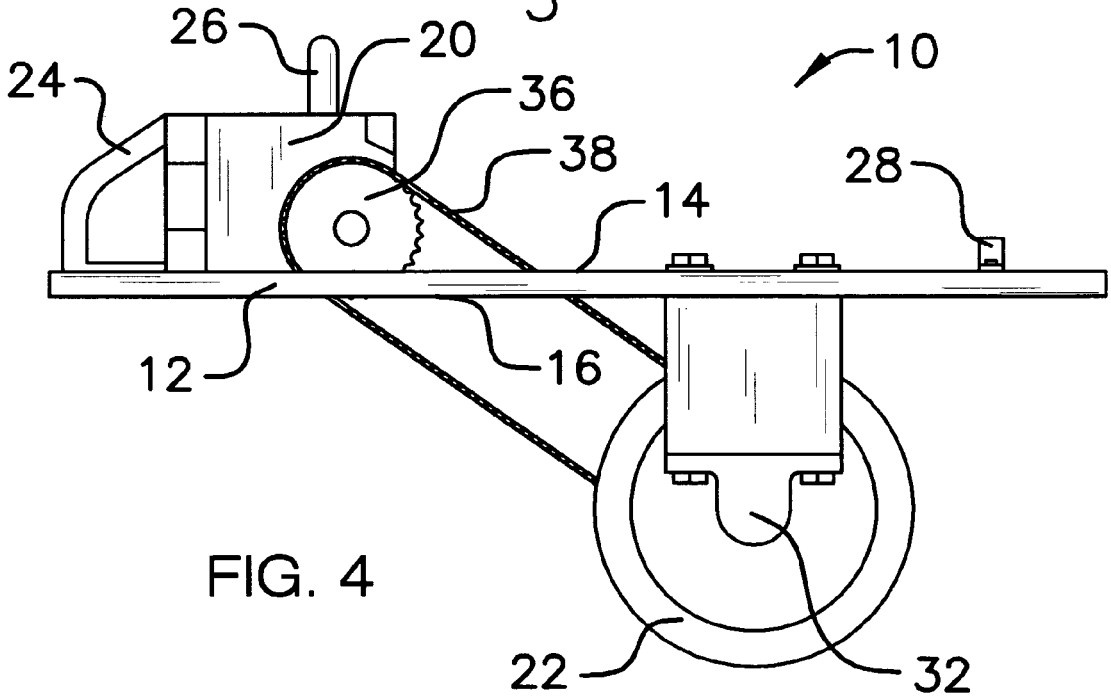
FIG. 4 is a left side view of the mortar mixing apparatus of the present invention.

In FIG. 4, the mortar mixing apparatus 10 is illustrated and will be described. More particularly, the mortar mixing apparatus 10 has the rigid planar safety shield 12 having the top side 14 and the bottom side 16. The mixer motor 20 is connected to the safety shield top side 14. The mixing blade 22 is rotatably connected to the safety shield bottom side 16. The mixing blade 22 is drivingly connected to the mixer motor 20. The first push-pull handle 24 is connected to the mixer motor 20. The second push-pull handle 26 is connected to the mixer motor 20. The forward handle 28 is connected to the safety shield 12. The bearing 32 is connected to the safety shield bottom side 16 in the present embodiment. The drive sprocket 36 is connected to the mixer motor 20. The drive chain 38 is drivingly connected to the mixer motor 20. The drive chain 38 is connected to the drive sprocket 36.

Figure 5:
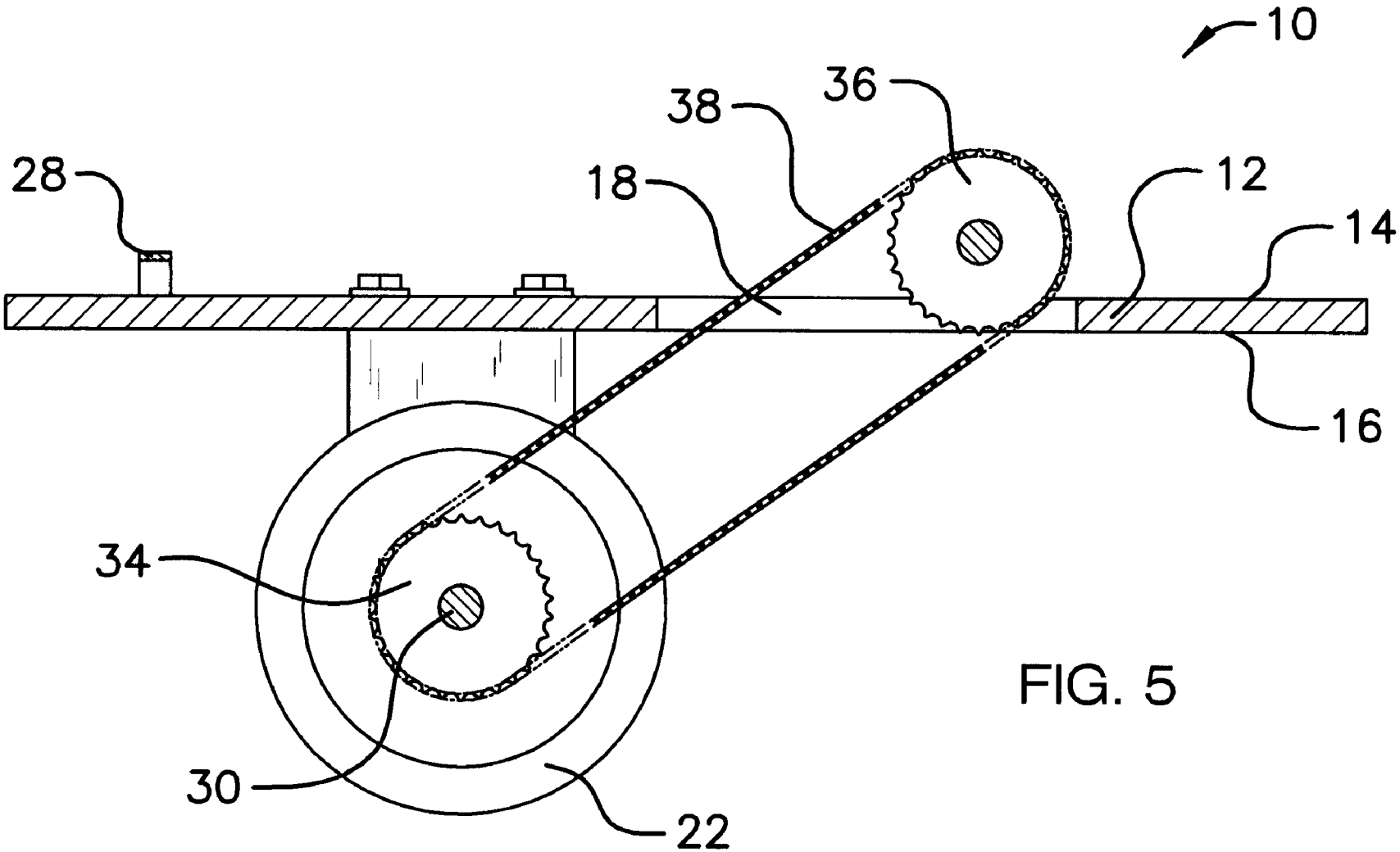
FIG. 5 is a section 5—5 view of FIG. 3 of the mortar mixing apparatus of the present invention.

In FIG. 5, the mortar mixing apparatus 10 is illustrated and will be described. More particularly, the mortar mixing apparatus 10 has the rigid planar safety shield 12 having the top side 14 and the bottom side 16. The safety shield 12 has the drive slot therethru 18. The mixing blade 22 is rotatably connected to the safety shield bottom side 16. The forward handle 28 is connected to the safety shield 12. The axle 30 is connected to the mixing blade 22. The driven sprocket 34 is connected to axle 30. The drive sprocket 36 is connected to the mixer motor 20 (shown in FIG. 1). The drive chain 38 is drivingly connected to the mixer motor 20. The drive chain 38 is connected to the drive sprocket 36. The drive chain 38 is connected to the driven sprocket 34.

In use it can now be understood that the mortar mixing apparatus 10 would be powered on and would simply slide back and forth over the top of the conventional wheelbarrow 40 to mix the concrete.

While a preferred embodiment of the mortar mixing apparatus has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, or a variety of wood may be used instead of the plywood safety panel described. Also, the mixing blades may also be made of heavy-duty plastic, wood, or similar material instead of the steel described. And although concrete mixers which is connectable with a conventional wheelbarrow have been described, it should be appreciated that the mortar mixing apparatus herein described is also suitable for mixing any material in a conventional wheelbarrow.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mortar mixing apparatus comprising:

a rigid planar safety shield, said safety shield having a top side and a bottom side, and of a planar dimension such as to be slidably supported upon the top of a wheelbarrow;

a mixer motor connected to said safety shield top side; and a mixing blade rotatably connected to said safety shield bottom side, said mixing blade drivingly connected to said mixer motor.

2. The mortar mixing apparatus of claim 1 further comprising:

a first push-pull handle connected to said mixer motor.

3. The mortar mixing apparatus of claim 1 further comprising:

a second push-pull handle connected to said mixer motor.

4. The mortar mixing apparatus of claim 1 further comprising:

a forward handle connected to said safety shield.

5. The mortar mixing apparatus of claim 1 further comprising:

an axle connected to said mixing blade.

6. The mortar mixing apparatus of claim 5 further comprising:

a bearing rotatably connected to said axle.

7. The mortar mixing apparatus of claim 6 wherein:

said bearing is a pillow block bearing.

8. The mortar mixing apparatus of claim 5 further comprising:

a driven sprocket connected to said axle.

9. The mortar mixing apparatus of claim 1 further comprising:

a drive sprocket connected to said mixer motor.

10. The mortar mixing apparatus of claim 1 further comprising:

a drive chain drivingly connected to said mixer motor.

11. The mortar mixing apparatus of claim 1 wherein:

said safety shield has a drive slot therethru.

12. A mortar mixing apparatus comprising:

a rigid planar safety shield, said safety shield having a top side and a bottom side;

a mixer motor connected to said safety shield top side;

a mixing blade rotatably connected to said safety shield bottom side, said mixing blade drivingly connected to said mixer motor;

a forward handle connected to said safety shield;

a first push-pull handle connected to said mixer motor; and a second push-pull handle connected to said mixer motor.

13. The mortar mixing apparatus of claim 12 further comprising:

an axle connected to said mixing blade.

14. The mortar mixing apparatus of claim 13 further comprising:

a bearing rotatably connected to said axle, said bearing is a pillow block bearing.

15. The mortar mixing apparatus of claim 14 further comprising:

a driven sprocket connected to said axle.

16. The mortar mixing apparatus of claim 15 further comprising:

a drive sprocket connected to said mixer motor.

17. The mortar mixing apparatus of claim 16 further comprising:

a drive chain drivingly connected to said mixer motor.

18. The mortar mixing apparatus of claim 17 wherein:

said safety shield has a drive slot therethru.

19. A mortar mixing apparatus comprising:

a rigid planar safety shield, said safety shield having a top side and a bottom side, said safety shield has a drive slot therethru;

a mixer motor connected to said safety shield top side;

a mixing blade rotatably connected to said safety shield bottom side, said mixing blade drivingly connected to said mixer motor;

a first push-pull handle connected to said mixer motor;

a second push-pull handle connected to said mixer motor;

a forward handle connected to said safety shield;

an axle connected to said mixing blade;

a bearing rotatably connected to said axle, said bearing is a pillow block bearing;

a driven sprocket connected to said axle;

a drive sprocket connected to said mixer motor; and a drive chain drivingly connected to said mixer motor, said drive chain connected to said drive sprocket, said drive chain connected to said driven sprocket.

* * * * *